US007439472B2

(12) United States Patent
Lee et al.

(10) Patent No.: US 7,439,472 B2
(45) Date of Patent: Oct. 21, 2008

(54) HEATING BODY

(75) Inventors: Young Jun Lee, Seoul (KR); Yang Kyeong Kim, Boocheon-si (KR); Jong Sik Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/457,274

(22) Filed: Jul. 13, 2006

(65) Prior Publication Data

US 2007/0012677 A1 Jan. 18, 2007

(30) Foreign Application Priority Data

Jul. 14, 2005 (KR) ..... 10-2005-0063720

(51) Int. Cl.
*H05B 1/02* (2006.01)

(52) U.S. Cl. ..... 219/494; 219/539; 219/552; 219/534

(58) Field of Classification Search ..... 219/494, 219/496, 501, 505, 535, 536, 539, 534, 552
See application file for complete search history.

(56) References Cited

U.S. PATENT DOCUMENTS

| | | | | |
|---|---|---|---|---|
| 2,898,571 | A * | 8/1959 | Moule et al. | 338/238 |
| 3,219,872 | A | 11/1965 | Hodge | |
| 3,699,309 | A | 10/1972 | Eck | |
| 5,079,475 | A * | 1/1992 | Oortman Gerlings et al. | 313/279 |
| 5,371,830 | A | 12/1994 | Wachenheim | |
| 5,602,441 | A * | 2/1997 | Ohsako et al. | 313/230 |
| 5,811,934 | A * | 9/1998 | Bunk et al. | 313/579 |
| 5,981,920 | A | 11/1999 | Kelly | |
| 6,469,426 | B1 * | 10/2002 | Hurst et al. | 313/315 |
| 6,516,143 | B2 * | 2/2003 | Toya et al. | 392/480 |
| 6,591,062 | B2 | 7/2003 | Scherzer et al. | |
| 6,713,945 | B2 | 3/2004 | Fuchs et al. | |
| 6,980,734 | B2 * | 12/2005 | Halpin | 392/407 |

FOREIGN PATENT DOCUMENTS

| | | |
|---|---|---|
| EP | 1168418 | 1/2002 |
| EP | 1182689 | 2/2002 |

OTHER PUBLICATIONS

U.S. Appl. No. 11/457,296, filed Jul. 13, 2006.
U.S. Appl. No. 11/457,254, filed Jul. 13, 2006.
English Language Abstract of EP 1 168 418.
English Language Abstract of EP 1 182 689.

* cited by examiner

*Primary Examiner*—Mark H Paschall
(74) *Attorney, Agent, or Firm*—Greenblum & Bernstein, P.L.C.

(57) ABSTRACT

A heating body is provided. The heating body includes a tube and a heating member disposed in the tube. When a radius from a center of the heating body to an outer circumference of the heating member is "r," a radius of the tube is equal to or greater than 1.6r.

12 Claims, 4 Drawing Sheets

HEATING BODY

BACKGROUND OF THE INVENTION

1. Field of the Invention

The present invention relates to a heating body.

2. Description of the Related Art

Generally, a heating body is a device for converting electric energy into heat energy A conventional heating body includes a filament that is a heating element, a quartz tube in which the filament is inserted, and a connection unit for connecting the filament to an external power source.

That is, the filament formed of a carbon material is inserted in the quartz tube and the quartz tube is sealed. The filament is connected to the external power source by the connection unit. The quartz tube is filled with inert gas such as vacuum gas or halogen gas so as to prevent the filament from be oxidized when the filament emits high temperature heat and thus increase the service life of the heating body.

Meanwhile, the carbon filament is formed in a spiral shape, a plate shape, a linear shape, or the like. The carbon filament may be connected an electrode by a clip or a spring providing a tension. Therefore, the filament is disposed in the quartz tube without contacting an inner surface of the quartz tube. The quartz tube is molten or broken at a temperature above 800° C. Therefore, when the carbon filament emitting heat contacts the inner surface of the quartz tube, the quartz tube may be damaged and thus the service life of the heating body is reduced. Therefore, the carbon filament is supported in the quartz tube by the clip or spring without directly contacting the inner surface of the quartz tube.

That is, in the conventional heat body, the carbon filament is tensioned by outer force not to contact the inner surface of the quartz tube. However, when the carbon filament emits high temperature heat, the carbon filament expands according to its thermal expansion coefficient. When the carbon filament expands, it may physically contact the inner surface of the quartz tube, thereby damaging the quartz tube and reducing the service life of the heating body.

SUMMARY OF THE INVENTION

Accordingly, the present invention is directed to a heating body that substantially obviates one or more problems due to limitations and disadvantages of the related art.

An object of the present invention is to provide a heating body that can prevent a heating member from contacting a tube enclosing the heating member.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a heating body including: a tube; and a heating member disposed in the tube, wherein, when a radius from a center of the heating body to an outer circumference of the heating member is "r," a radius of the tube is equal to or greater than 1.6r.

In another aspect of the present invention, there is provided a heating body including: a tube; and a heating member disposed in the tube, wherein, when a radius from a center of the heating body to an outer circumference of the heating member, a radius of the tube is within the range of 1.5r-1.7r.

According to the present invention, when considering the thermal property of the quartz tube, the radiation heat transmission property and reflectivity of the tube, the slight convection current transmission on the surface of the tube, the radius R of the tube is set to be equal to or greater than 1.6r and thus the service life of the tube can be maximized under the predetermined using condition.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts. While this invention is described with reference to preferred embodiments thereof, it will be understood by those skilled in the art that various changes in form and details may be made therein without departing from the spirit of the invention.

Figure 1:
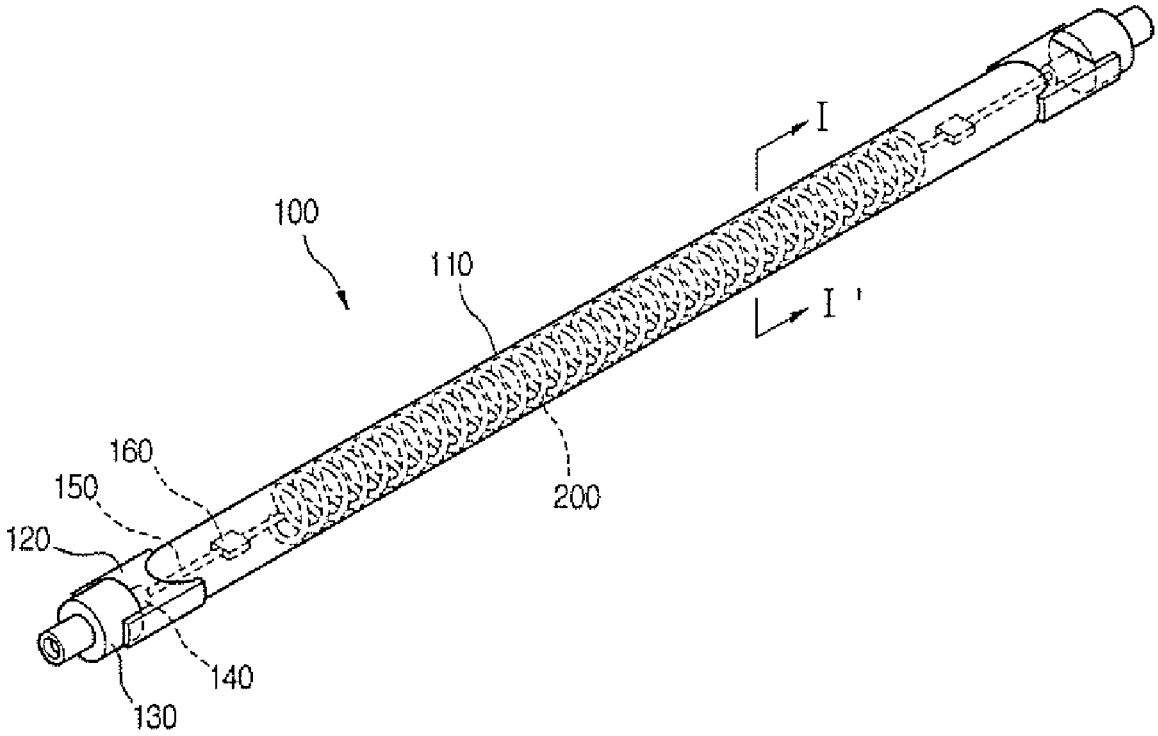
FIG. 1 is a perspective view of a heating body according to an embodiment of the present invention.

FIG. 1 is a perspective view of a heating body according to an embodiment of the present invention.

Referring to FIG. 1, a heating body 100 includes a tube 110 defining a space for receiving internal parts and a heating member 200 disposed in the tube to emit heat.

The heating body 100 includes a lead rod 150 supporting the heating member 200 without allowing the heat member 200 to contact an inner surface of the tube 110 and a connection member 160 for connecting the lead rod 150 to the heating member 200. In addition, the heating body 100 further includes a metal member 140 connected to a portion of the lead rod 150 to allow an electric conduction between an external power source and the heating member 200 and an insulation member 130 for insulating the metal member 200 from an external side. The heating body 100 further includes a sealing member 120 partly enclosing and supporting the metal member 140, insulation member 130 and tube 110.

The tube 110 functions to not only define the space for receiving the internal parts but also to protect the internal parts. Since the heating body 100 emits heat above hundreds ° C., the tube 110 must be formed of a material having a sufficient rigidity and a sufficient heat-resistance. For example, the tube 110 may be formed of quartz. In addition, the tube 110 must be sealed to isolate the heating member 200 from the external side. Inert gas may be filled in the tube 110 to prevent the heating member 200 from changing in the chemical or physical property.

The heat member 200 emits heat using electric energy applied. The heating member 200 may be formed of a material selected from the group consisting of a carbon-based material, a tungsten-based material, and a nickel/chrome-based alloy.

The connection member 160 includes a plurality of sections connected to opposite ends of the heating member 200. Therefore, the connection member 160 connects the heating member 200 to the lead rod 150. Then, the heating member 200 is tensioned not to maintain a state where it does not contact the inner surface of the tube 100 and connected to the external power source.

The lead rod 150 is connected to the heating member 200 by the connection unit 160 to maintain the tensioned state of the heating member 200. Then, even when the heating member 200 emits heat, the heating member 200 does not expand not to contact the inner surface of the tube 100, thereby stably emitting the heat. The lead rod 150 extends up to an external side of the tube 110. Therefore, the sealing state of the tube 110 is maintained and the heating member 200 can be connected to the external power source.

The metal member 140 is connected to the end of the lead rod 150 extending out of the tube 110 to transmit electric energy from the external power source to the heating member 200 via the lead rod 150. Then, the heating member 20 receiving the electric energy emits the heat.

The insulation member 130 insulates an exposed portion of the metal member 140 to an external side to prevent the electric leakage of the metal member 140. The insulation member 130 is designed to be fitted in a product where the heating body 100 will be installed.

The sealing member 120 protects the end portion of the lead rod 150 and the connection portion of the metal member 140 from external impact. The sealing member 120 is assembled with the insulation member 130 and the tube 110 to maintain a predetermined shape of the heating body 100.

Figure 2:
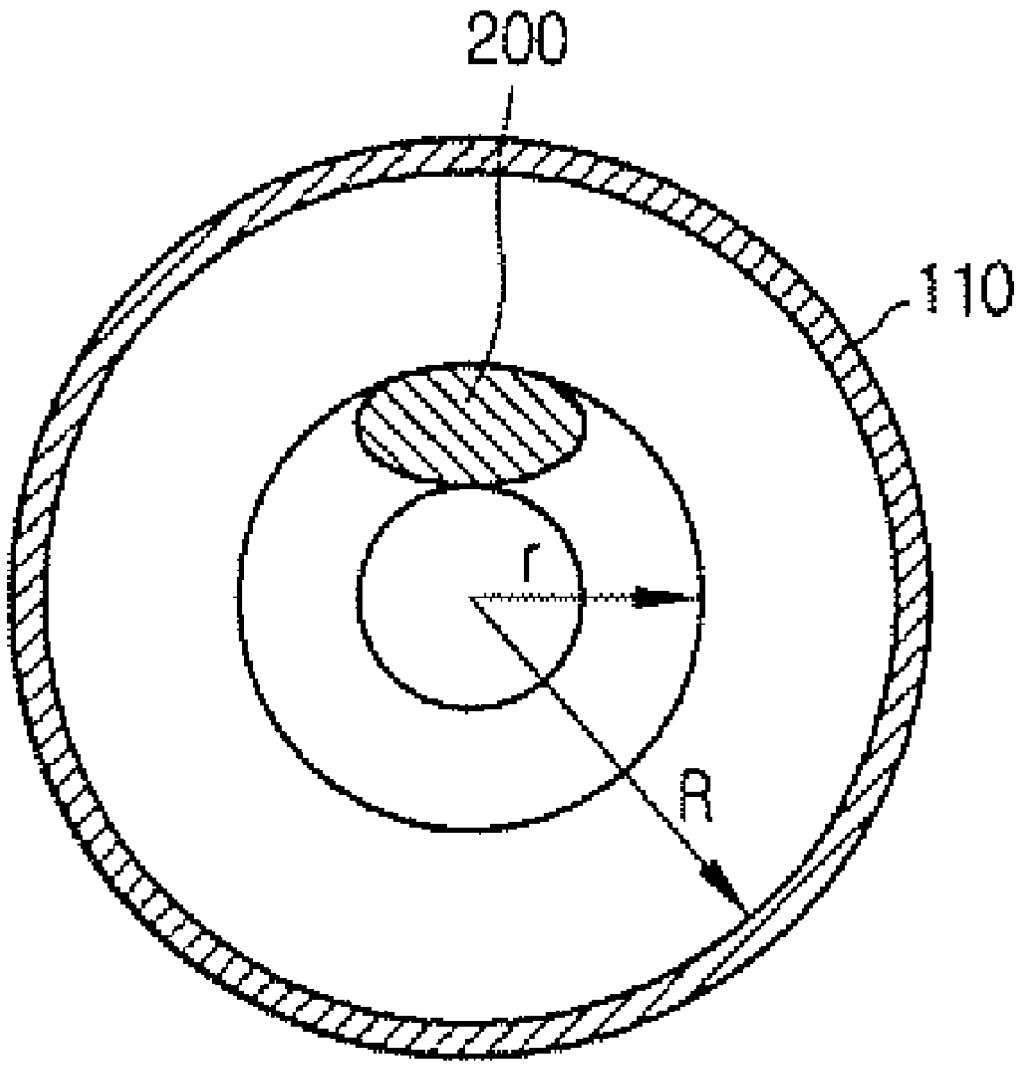
FIG. 2 is a sectional view taken along line I-I' of FIG. 1.

FIG. 2 is a sectional view taken along line I-I' of FIG. 1.

Referring to FIG. 2, the heating body 100 is disposed in the tube 110. At this point, a radius from a center of the heating body 100 to an outer circumference of the heating member 200 is defined as "r".

According to the present invention, a radius R of the tube 110 is set to be equal to or greater than 1.6 times the radius r. This can be represented by the following equation.

$$R \geqq 1.6 \times r \qquad \text{[Equation 1]}$$

When the heating body 100 is designed to satisfy Equation 1, the service life of the tube 110 can be maximized under a predetermined using condition. This can be analyzed by the computation fluid dynamics. This will be described later.

As described above, in order to maximize the service life of the tube under the predetermined using condition, the radius R of the tube 110 may be equal to or greater than 1.6r throughout an overall length of the tube 110. The tube 110 maintains a uniform shape along the overall length thereof.

Figure 3:
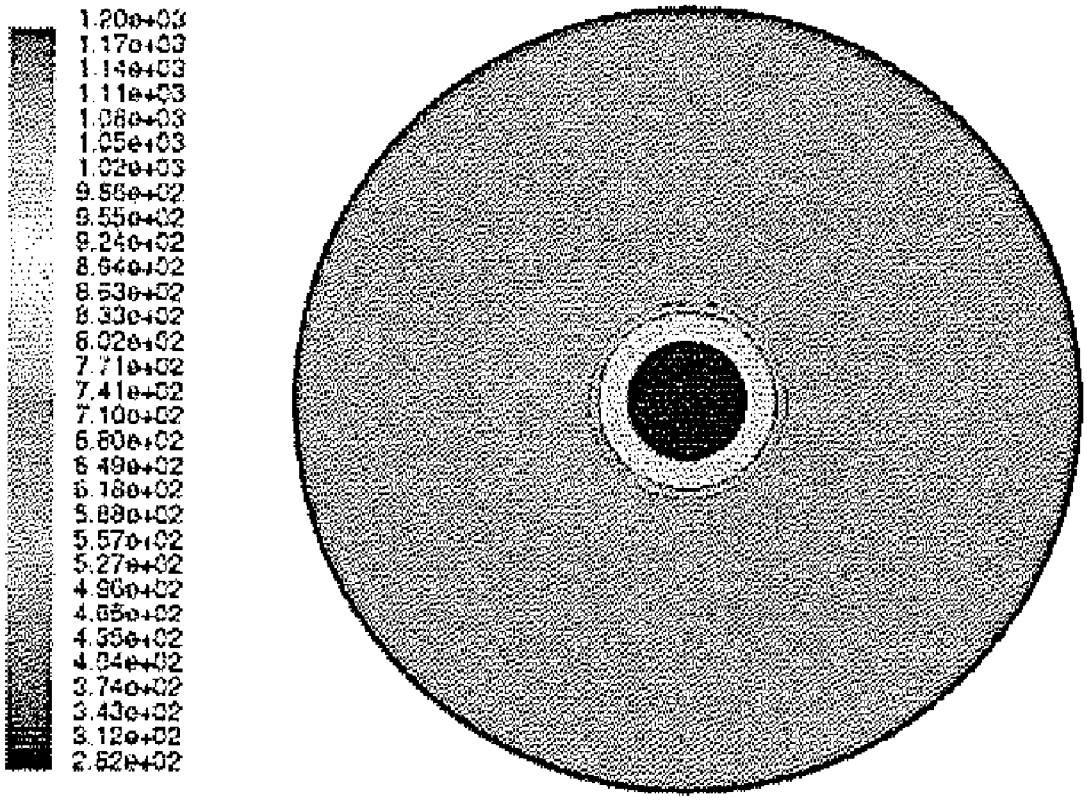
FIG. 3 is a view of an analysis result of the computational fluid dynamic for the heating body of the present invention.
Figure 4:
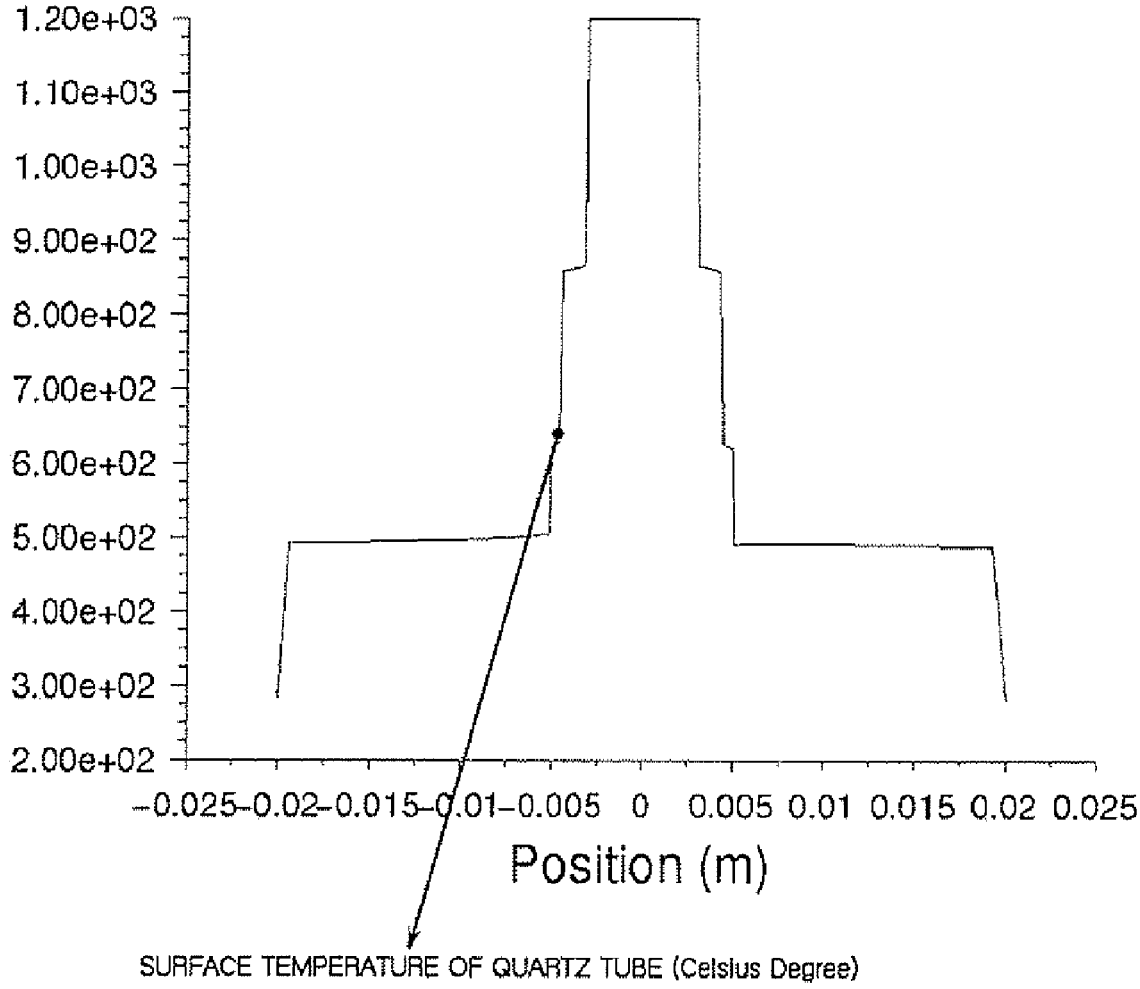
FIG. 4 is a graph illustrating the analysis result of FIG. 3.

FIG. 3 is a view of an analysis result of the computational fluid dynamic for the heating body of the present invention and FIG. 4 is a graph illustrating the analysis result of FIG. 3. Since the convection current around the tube 110 is insignificant for the analysis result, the analysis result is obtained considering the radiation of the tube 110.

Referring to FIGS. 3 and 4, when the radius R of the tube 110 was 1.5r, the temperature of the tube 110 was ° C. When the radius R of the tube 110 was 1.5R-1.7R, the temperature of the tube 110 was 600° C.±100° C. When the tube 110 was formed of quartz, the tube 110 can be stabilized at a temperature less than 800° C. when considering the thermal property of the quartz. When considering the radiation heat transmission and reflectivity of the tube and slight convention current heat transmission on a surface of the tube 110, it is noted that the radius R of the tube 110 may be set to be equal to or greater than 1.6r. In this case, the service life of the tube 110 can be maximized under the predetermined using condition of the tube 110.

In the heating body according to the present invention, when considering the thermal property of the quartz tube, the radiation heat transmission property and reflectivity of the tube, the slight convection current transmission on the surface of the tube, the radius R of the tube is set to be equal to or greater than 1.6r and thus the service life of the tube can be maximized under the predetermined using condition.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A heating body comprising:

a tube;

a heating member disposed in the tube, a lead rod which supports the heating member such that the heating member is spaced from an inner surface of the tube;

a connector which connects the lead rod to the heating member;

a metal conductor connected to an end of the lead rod;

an insulator which insulates the metal member from an external side; and a seal at least partially enclosing and supporting the metal conductor, the insulator and the tube;

wherein, when a radius from a center of the heating body to an outer circumference of the heating member is "r," a radius of the tube is equal to or greater than 1.6r.

2. The heating body according to claim 1, wherein the radius of the tube is equal to or greater than 1.6r throughout an overall length of the tube.

3. The heating body according to claim 1, wherein a shape of the tube is uniform along an overall length of the tube.

4. The heating body according to claim 1, wherein the radius 1.6r of the tube is calculated through the computational fluid dynamics.

5. The heating body according to claim 1, wherein the tube comprises quartz.

6. A heating body comprising:

a tube;

a heating member disposed in the tube, a lead rod which supports the heating member such that the heating member is spaced from an inner surface of the tube;

a connector which connects the lead rod to the heating member;

a metal conductor connected to an end of the lead rod;

an insulator which insulates the metal member from an external side; and a seal at least partially enclosing and supporting the metal conductor, the insulator and the tube;

wherein, when a radius from a center of the heating body to an outer circumference of the heating member is "r", a radius of the tube is within the range of 1.5r-1.7r.

7. The heating body according to claim 6, wherein the radius of the tube is within the range of 1.6r-1.7r.

8. The heating body according to claim 6, wherein the radius of the tube is within the range of 1.5r-1.7r throughout an overall length of the tube.

9. The heating body according to claim 6, wherein the radius of the tube is within the range of 1.6r-1.7r throughout an overall length of the tube.

10. The heating body according to claim 6, wherein a shape of the tube is uniform along an overall length of the tube.

11. The heating body according to claim 6, wherein the radius of the tube within the range of 1.5r-1.7r is calculated through the computational fluid dynamics.

12. The heating body according to claim 6, wherein the tube comprises quartz.

* * * * *